United States Patent [19]

Evälahti

[11] Patent Number: 4,784,726

[45] Date of Patent: Nov. 15, 1988

[54] PAPER MACHINE HEAD BOX WITH ADJUSTABLE PERFORATED PLATE FLOW DUCTS

[75] Inventor: Osmo Evälahti, Karhula, Finland

[73] Assignee: A. Ahlstrom Corporation, Karhula, Finland

[21] Appl. No.: 942,304

[22] Filed: Dec. 16, 1986

[30] Foreign Application Priority Data

Dec. 17, 1985 [FI] Finland ..... 854936

[51] Int. Cl.[4] ..... D21F 1/02

[52] U.S. Cl. ..... 162/336; 162/216; 162/343

[58] Field of Search ..... 162/216, 336–340, 162/343, 344, 347

[56] References Cited

U.S. PATENT DOCUMENTS 2,956,623 10/1960 Ikavalko ..... 162/216
4,137,124 1/1979 Bubik et al. ..... 162/344
4,432,835 2/1984 Waris et al. ..... 162/212
4,687,548 8/1987 Ilmoniemi et al. ..... 162/216

FOREIGN PATENT DOCUMENTS 3514554 3/1986 Fed. Rep. of Germany ..... 162/336
30095 12/1958 Finland .

*Primary Examiner*—David L. Lacey
*Assistant Examiner*—K. M. Hastings
*Attorney, Agent, or Firm*—Nixon & Vanderhye

[57] ABSTRACT

A paper machine head box includes perforated plates being used as a distributor and a turbulence generator and having flow ducts, of which the ones at the edges are of different size than the remaining flow ducts. According to a preferred embodiment, slides, which are movable sideways, are provided at the ends of slice ducts at both edges of the perforated plates in order to regulate the flow. The slides and the perforated plates define the outermost flow ducts of the turbulence generator and the distributor.

20 Claims, 4 Drawing Sheets

PAPER MACHINE HEAD BOX WITH ADJUSTABLE PERFORATED PLATE FLOW DUCTS

TECHNICAL FIELD

The present invention relates to a head box for paper-making machine which head box includes a turbulence generator and/or a distributor comprising a perforated plate having a large number of flow ducts in rows extending across the head box.

PRIOR ART

Because of the retarding friction caused by the side walls of the head box, less pulp flows through the slice of the head box onto the edges of the wire than onto the center. This results in a decrease of grammage at the edges of the web and in quite wide trimmings.

To avoid the problem, Finnish patent specification no. 30095 (U.S. Pat. No. 2,956,623) for example suggests that pulp be added to the edges of the wire from outside. This, however, usually creates an edgewave as a flow fed-in from a side, even if guided by the design of the nozzle, is never precisely parallel with the head box flow.

DISCLOSURE OF INVENTION

The object of the invention is to provide a head box construction which eliminates or minimizes the above disadvantages.

The head box according to the invention is substantially characterized by the feature that the size of the flow duct at the edges is different from the size of the remaining ducts in the perforated plate.

According to the present invention there is provided a head box for a paper-making machine including a turbulence generator and/or a distributor comprising a perforated plate having a plurality of flow ducts in rows extending through the head box, characterized in that the size of the flow ducts in at least one edge area is different from the size of the remaining flow ducts in the perforated plate.

According to a preferred embodiment of the invention both sides of the perforated plate are provided with slides which are sidewardly displaceable and form with the perforated plates the laterally outermost flow ducts of the perforated plate and/or the turbulence generator. Whilst the need to adjust the cross section area of the flow ducts is in general small, approximately 0.5 to 2%, but an apparatus according to the invention allows a remarkably wider adjustment range.

BRIEF DESCRIPTION OF DRAWINGS

The invention is described further, by way of example, with reference to the drawings, in which.

MODES OF CARRYING OUT THE INVENTION

Figure 1:
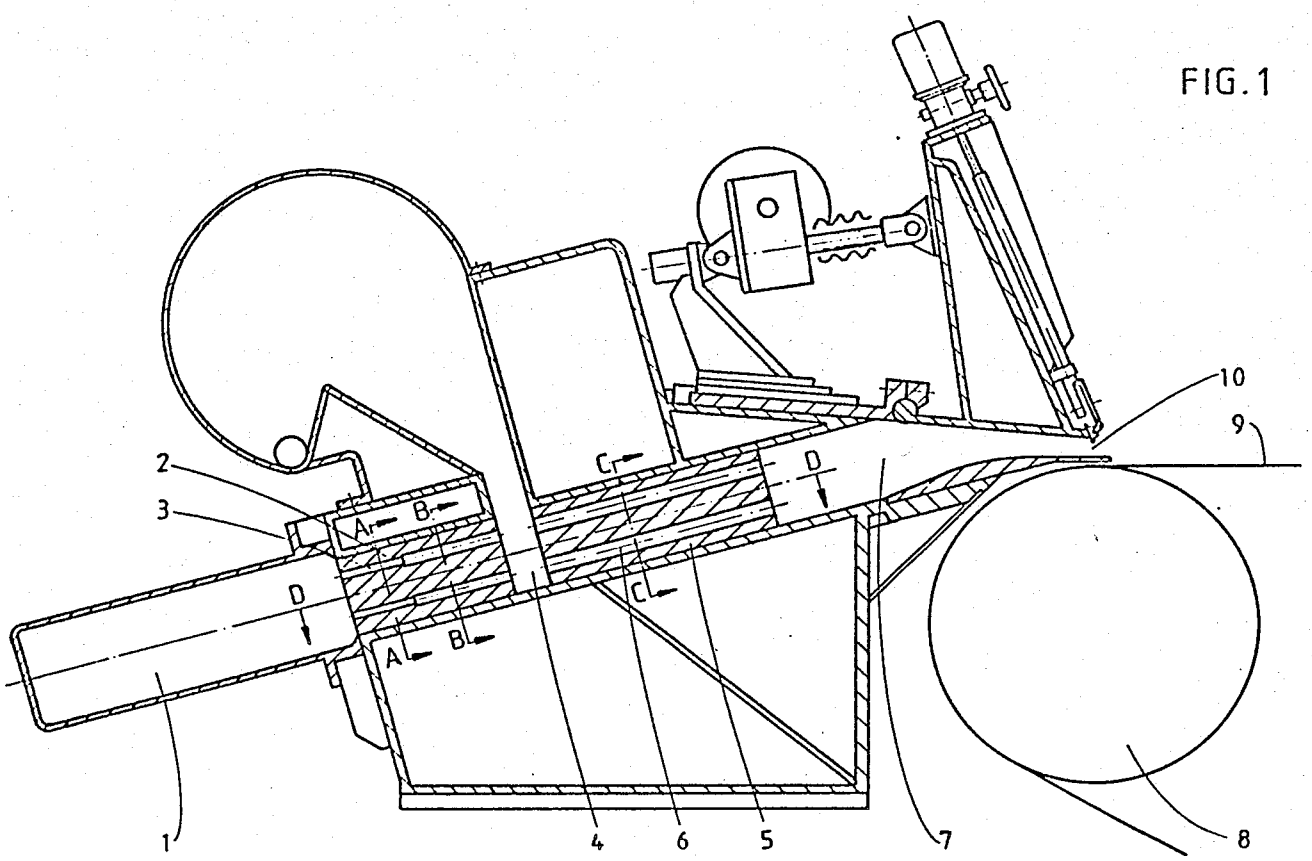
FIG. 1 is a longitudinal cross section through a paper-making machine head box according to the invention.
Figure 2:
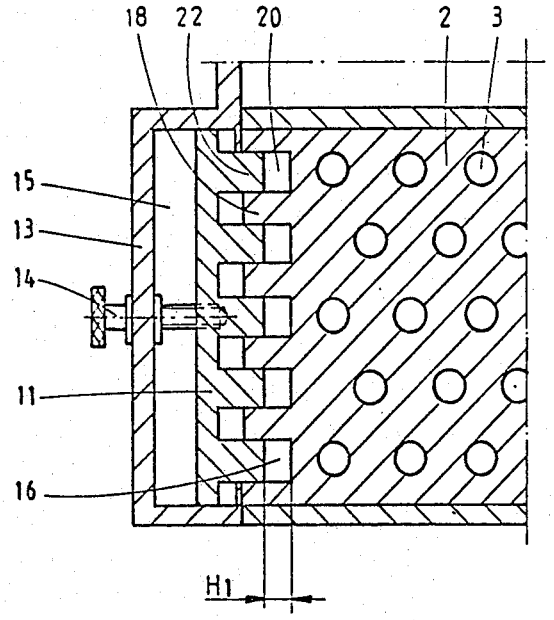
FIG. 2 is a section along line A—A of FIG. 1.
Figure 3:
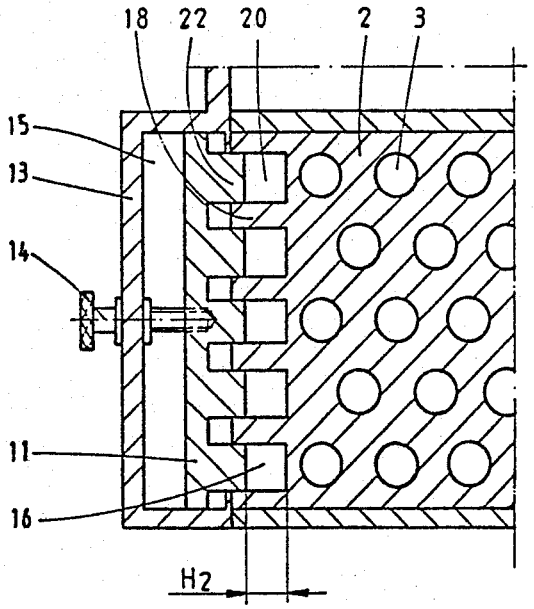
FIG. 3 is a section along line B—B of FIG. 1.
Figure 4:
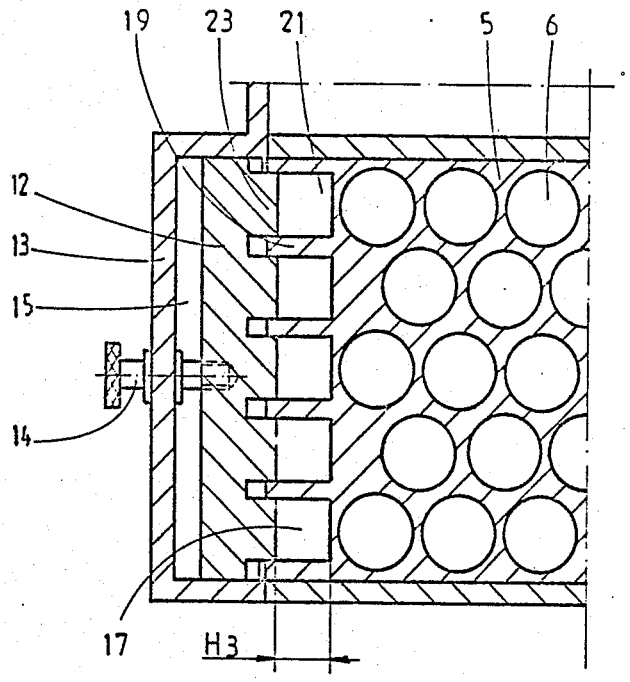
FIG. 4 is a section along line C—C of FIG. 1.

In the drawings there is illustrated a cross header 1 of a head box for a paper-making machine and by means of with which pulp is introduced into the head box of FIG.

1. From the cross header 1 the pulp flows to an apertured block or perforated plate 2 extending through the head box and having several superimposed stepped or off-set rows of flow ducts 3 extending in the machine direction. Perforated plate 2 is used as a distributor for spreading the pulp supplied into the head box evenly over the whole width of the machine. Flow ducts 3 lead to an expansion chamber 4. An apertured block or perforated plate 5, which is used as a turbulence generator and has flow ducts 6 of appropriate design, is disposed in the flow direction downstream of the expansion chamber 4. Flow ducts 6 lead to a slice duct 7 from which the pulp is discharged as a spray through a slice 10 onto a wire 9 running over a breast roll 8.

As is illustrated in FIGS. 2 to 6, both edges of the perforated plates 2 and 5 are provided with slides 11 and 12 which can be adjustably displaced aideways by means of screws 14 in a side wall 13 of the head box. The slides 11, 12 are displaceable towards and away from the plates 2, 5.

The slides 11, 12 are displaceably disposed in recesses 15 in the side walls 13. The distributor 2, the turbulence generator 5 and the slides 11, 12 disposed at their edges and the outermost flow ducts 16 and 17 of the turbulence generator constitute a control device. The edges of the perforated plates 2 and 5 are provided with projections 18 and 19 and grooves 20 and 21 defined by the projections between them; the slides 11 and 12 are provided with gliding projections 22 and 23 disposed in a corresponding position between the grooves so that the thus formed inter-disposed castellated portions define flow ducts 16 and 17 between the perforated plates and the slides. The width H1, H2 and H3 and thus the cross-section area of the flow ducts and further the volume of pulp flowing through the ducts 16, 17 can be controlled by moving the slides 11, 12 sideways.

Figure 5:
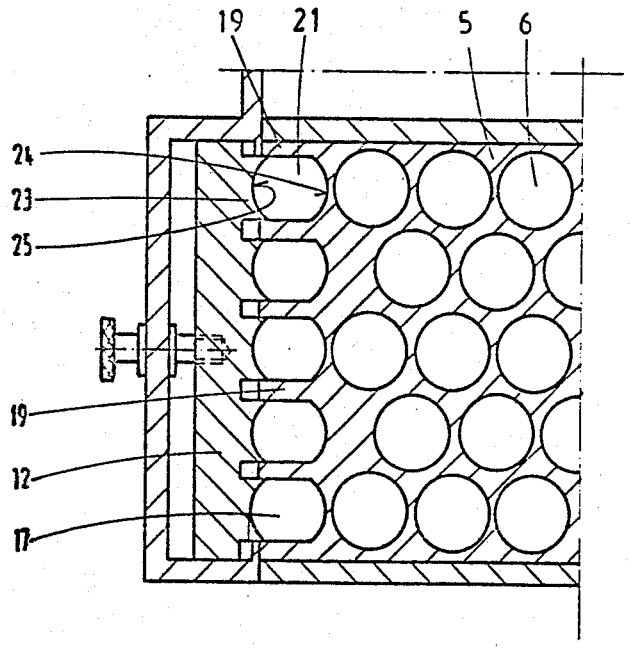
FIG. 5 is a section along line C—C of a modified embodiment.
Figure 6:
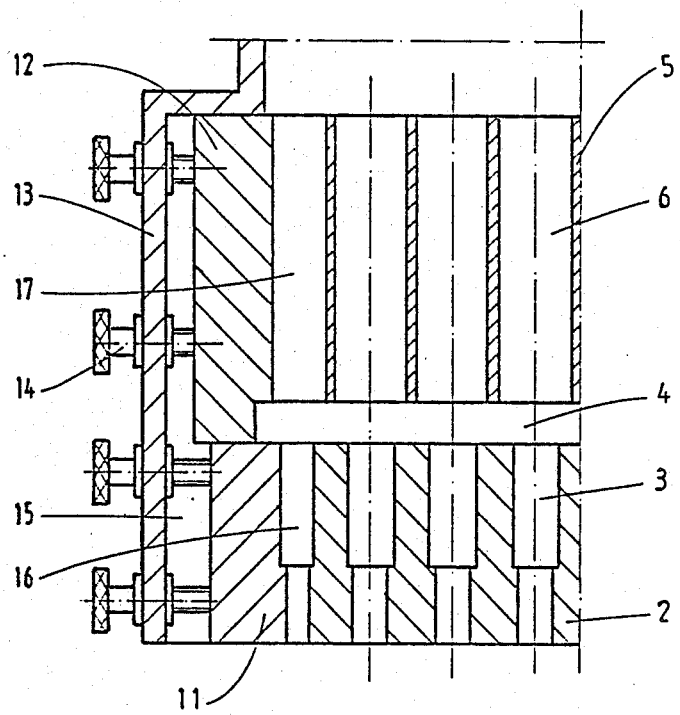
FIG. 6 is a section along line D—D of FIG. 1.

In the alternative embodiment illustrated in FIG. 5, the bottom 24 of the grooves 21 between the projections 19 of the perforated plate 5 is curved. Also the end surfaces 25 in the projections 23 of the slide 12 are curved so as to form flow ducts 17 with two rounded sides.

INDUSTRIAL APPLICABILITY

The apparatus according to the invention allows accurate adjustment of the edge flow in the head box and permits the provision of an even flow of pulp through the slice onto the whole width of the paper-making machine. Adjustment of the edge flow does not cause transverse flows as the flow in the ducts are wider at the edges than the other ducts, but in special cases it may be advantageous to design them smaller.

The invention is not limited to the embodiments presented here as examples only, but it can be modified within the scope of protection defined by the patent claims. Thus, for instance, the slides 11 and 12 can be provided as one part or they can be composed of parts which are disposed on top of each other and are movable in relation to each other.

We claim:

1. A head box, including side walls, for a paper-making machine, comprising:

a cross header in communication with a perforated plate having a plurality of flow ducts extending through the head box, the plate having a pair of side edge areas, each of said side edge areas having a plurality of outermost flow ducts of substantially uniform size relative to one another; the size of the outermost flow ducts in at least one of said side edge areas of the plate being different than the size of the non-edge area flow ducts in the perforated plate; means carried by the head box for substantially uniformly altering the size of the outermost flow ducts in said at least one of said side edge areas; and a slice.

2. A head box as recited in claim 1, wherein said altering means includes slides provided in both of said side edge areas of the perforated plate and said slides are movable sidewardly and form with the perforated plate the outermost flow ducts.

3. A head box as recited in claim 2, wherein the slides are movable with screws disposed in the side walls of the head box.

4. A head box as recited in claim 2, wherein the cross section of the outermost flow ducts is square.

5. A head box as recited in claim 2, wherein each of the outermost flow ducts have two sides which are rounded.

6. A head box as recited in claim 1, wherein the slides are slidingly disposed in recesses in the side walls of the head box.

7. A head box as recited in claim 1 wherein the sizes of the flow ducts in both edge areas of the plate are different from the size of the non-edge area flow ducts in the perforated plate.

8. A head box as recited in claim 1 wherein said perforated plate comprises means for generating turbulence.

9. A head box as recited in claim 8 wherein said perforated plate comprises a first perforated plate, and further comprising a second perforated plate in communication with said cross header, said second perforated plate having a plurality of flow ducts extending through the head box, the second plate having a pair of side edge areas; each of said side edge areas having a plurality of outermost flow ducts, the size of the outermost flow ducts in at least one of said side edge areas being different from the size of the non-edge area flow ducts of the second perforated plate; and said second plate comprising a distributor means for spreading the pulp supplied into the head box evenly over the width of the machine.

10. A head box as recited in claim 9 wherein said perforated plates have outermost flow ducts of different size in the side edge areas than in the non-edge areas and comprise means for providing an even flow of pulp through the slice, including the edges, onto the whole width of a paper making machine associated with said head box.

11. A head box as recited in claim 1 wherein said perforated plate has outermost flow ducts of different size in both of said side edge areas than in the non-edge areas and comprises means for providing an even flow of pulp through the slide, including the edges, onto the whole width of a paper making machine associated with said head box.

12. A head box as recited in claim 1 wherein said perforated plate comprises a distributor means for spreading the pulp supplied into the head box evenly over the whole width of the machine, said head box having an expansion chamber, the flow ducts therein cooperating with said expansion chamber.

13. A head box, including side walls for a paper making machine, comprising: a cross header; means defining a distributor for spreading pulp supplied into the head box evenly over the whole width of a paper making machine with which the head box is associated; said distributor means including a perforated plate having a plurality of flow ducts extending through the head box, the plate having a pair of side edge areas; an expansion chamber; said perforated plate communicating with said cross header and with said expansion chamber wherein pulp flows through said flow ducts from said cross header to said expansion chamber; and a slice; and wherein each of said edge areas has a plurality of outermost flow ducts, the size of the outermost flow ducts in at least one of said side edge areas of said plate being different than the size of the non-edge area flow ducts of said perforated plate, the outermost flow ducts in said one side edge area being substantially uniform in size with respect to each other and means carried by said head box for substantially uniformly altering the size of the outermost flow ducts in said at least one side edge area.

14. A head box as recited in claim 13, wherein said altering means alters the size of the outermost flow ducts in both side edge areas and comprises slides in both side edges of the perforated plate, said slides being movable sidewardly and forming with the perforated plate the outermost flow ducts.

15. A head box as recited in claim 13 wherein said perforated plate comprises a first plate; and wherein said head box further comprises turbulence generator means including a second perforated plate having a plurality of flow ducts extending through the head box, the second plate having a pair of side edge areas, each of said side edge areas having a plurality of outermost flow ducts, and the size of the outermost flow ducts in at least one of said side edge areas of said second plate being different than the size of the non-edge area flow ducts of said second plate; said flow ducts in said second plate communicating with said cross header and said slice.

16. A head box as recited in claim 15 wherein said altering means comprises means for adjusting the size of both of side edge area outermost flow ducts of both said first and second plates.

17. A head box as recited in claim 16 wherein said perforated plates and said means for adjusting the size of the side edge outermost flow ducts of said plates comprise means for providing accurate adjustment of the edge flow in the head box and providing an even flow of pulp through the slice onto the whole width of a paper making machine associated with the head box.

18. A head box as recited in claim 15, wherein said altering means comprises slides in both side edges area of the perforated plates and said slides are movable sidewardly and form with the perforated plates the outermost flow ducts of the distributor means and turbulence generator means.

19. A head box, including side walls, for a paper making machine, comprising:

a cross header in communication with a perforated plate having a plurality of flow ducts extending through the head box, the plate having a pair of side edge areas, each of said side edge areas having a plurality of outermost flow ducts; the size of the outermost flow ducts in at least one of said side edge areas of the plate being different than the size of the non-edge area flow ducts in the perforated plate; the edges of the perforated plate being provided with projections, and grooves defined between said projections, and corresponding gliding projections of the slides being disposed in said grooves so as to define the outermost flow ducts between the perforated plate and the slides, so that the width of the outermost ducts is adjustable, the outermost flow ducts along each side edge area being of substantially uniform cross-sectional area each with the other in their adjusted widths, and a slice.

20. A head box, including side walls, for a paper making machine, comprising: a cross header; means defining a distributor for spreading pulp supplied into the head box evenly over the whole width of a paper making machine with which the head box is associated; said distributor means including a perforated plate having a plurality of flow ducts extending through the head box, the plate having a pair of side edges areas, each of said side edge areas having a plurality of outermost flow ducts; an expansion chamber; said perforated plate communicating with said cross header and with said expansion chamber, wherein pulp flows through said flow ducts from said cross header to said expansion chamber; and a slice; and wherein the size of the outermost flow ducts in at least one of said side edge areas of said plate is different than the size of the non-edge area flow ducts of said perforated plate; slides provided in both of said side edges of the perforated plate and said slides being movable sidewardly and forming with the perforated plate the outermost flow ducts, the edges of the perforated plate being provided with projections, and grooves defined between said projections, and corresponding gliding projections of the slides being disposed in said grooves so as to define the outermost flow ducts between the perforated plate and the slides so that the width of the outermost ducts is adjustable, the outermost flow ducts along each side edge area being of substantially uniform cross-sectional area each with the other in their adjusted widths.

* * * * *